US010744361B2

(12) United States Patent
Duval

(10) Patent No.: US 10,744,361 B2
(45) Date of Patent: Aug. 18, 2020

(54) COLLAPSIBLE EXERCISE BOARD AND EQUIPMENT

(71) Applicant: Zelda Duval, New York, NY (US)

(72) Inventor: Zelda Duval, New York, NY (US)

( * ) Notice: Subject to any disclaimer, the term of this patent is extended or adjusted under 35 U.S.C. 154(b) by 0 days.

(21) Appl. No.: 15/942,468

(22) Filed: Mar. 31, 2018

(65) Prior Publication Data

US 2018/0280752 A1 Oct. 4, 2018

Related U.S. Application Data

(60) Provisional application No. 62/479,988, filed on Mar. 31, 2017.

(51) Int. Cl.

*A63B 21/00* (2006.01)
*A63B 23/04* (2006.01)
*A63B 71/00* (2006.01)

(52) U.S. Cl.

CPC .... *A63B 21/00047* (2013.01); *A63B 21/4027* (2015.10); *A63B 21/4037* (2015.10); *A63B 23/0458* (2013.01); *A63B 71/0036* (2013.01); *A63B 2210/50* (2013.01)

(58) Field of Classification Search

CPC ..... A63B 21/00047; A63B 23/0458–0464; A63B 2210/50

USPC ..... 182/33

See application file for complete search history.

(56) References Cited

U.S. PATENT DOCUMENTS 2,658,754 A * 11/1953 Courtney ..... A61G 13/009 482/145
3,295,847 A * 1/1967 Matt, Sr. ..... A63B 22/16 482/80
4,133,531 A * 1/1979 Arteaga ..... A63B 69/0097 273/395
4,478,413 A * 10/1984 Siwula ..... A63B 21/153 482/123
4,856,775 A * 8/1989 Colledge ..... A63B 21/0552 482/148
5,066,000 A * 11/1991 Dolan ..... A63B 23/0464 472/90
5,076,579 A * 12/1991 Rickey ..... A63B 23/00 482/140
5,275,579 A * 1/1994 Wilkinson ..... A47C 3/20 248/157
5,322,490 A * 6/1994 Van Der Hoeven ..... A63B 69/0022 472/90
5,474,509 A * 12/1995 Hodgdon ..... A63B 23/0458 482/142

(Continued)

*Primary Examiner* — Nyca T Nguyen
(74) *Attorney, Agent, or Firm* — Andrew Morabito

(57) ABSTRACT

An exercise board comprising a first top and second top rotatably engaged, wherein the first top has a first cavity and the second top has a second cavity, a board rotatably engaged along a first edge of the first board is rotatably engaged with a first edge of the first cavity, and a step foldable and comprised of a upper step and a lower step; a upper front panel extending between the upper step and the lower step and rotatably engaged to the upper step and the lower step; a lower front panel extend from the lower step and rotatably engaged with the lower step; a front and a rear side panels on each side of the steps being rotatable relative to one another; and a rear panel rotatably engaged with the upper step and both of the rear side panels rear panel.

18 Claims, 7 Drawing Sheets

(56) References Cited

U.S. PATENT DOCUMENTS 5,658,222 A * 8/1997 Brown ..... A63B 21/0552 482/51
5,697,870 A * 12/1997 Osborn ..... A63B 23/0458 482/52
5,839,991 A * 11/1998 Hall ..... A63B 23/00 482/23
6,110,083 A * 8/2000 Riser ..... A63B 21/154 482/142
6,422,981 B1 * 7/2002 Riser ..... A63B 21/154 482/142
6,634,998 B2 * 10/2003 Siaperas ..... A63B 21/04 482/123
6,837,838 B2 * 1/2005 List ..... A63B 21/169 482/146
7,104,901 B1 * 9/2006 Mason ..... A63B 5/16 473/446
7,601,101 B2 * 10/2009 Jackson ..... A63B 21/04 482/142
7,736,285 B2 * 6/2010 Brown, Jr. ..... A63B 21/04 482/121
8,141,680 B2 * 3/2012 Wigutoff ..... E04G 1/28 182/223
8,678,981 B2 * 3/2014 Cohen ..... A63B 23/0417 482/141
8,715,144 B1 * 5/2014 Friess ..... A63B 21/4035 482/123
8,875,840 B2 * 11/2014 Chancler ..... A47C 9/10 182/33
8,974,355 B2 * 3/2015 Austin ..... A63B 21/0552 482/130
9,492,705 B2 * 11/2016 Hong ..... A63B 21/0442
9,649,522 B2 * 5/2017 Wyatt ..... A63B 71/0036
9,895,576 B1 * 2/2018 Orgal ..... A63B 23/0458
2007/0037671 A1 * 2/2007 Murphy ..... A63B 21/00192 482/79
2007/0087920 A1 * 4/2007 Dachraoui ..... A63B 21/0552 482/123
2008/0302312 A1 * 12/2008 Steffey ..... A01K 1/035 119/849
2009/0124464 A1 * 5/2009 Kastelic ..... A63B 17/04 482/52
2010/0066022 A1 * 3/2010 Gelzinis ..... A63B 67/06 273/396
2011/0207534 A1 * 8/2011 Meldeau ..... A63B 23/0458 463/39
2011/0218059 A1 * 9/2011 Leone ..... A63B 69/00 473/452
2013/0090216 A1 * 4/2013 Jackson ..... A63B 21/018 482/52
2014/0141949 A1 * 5/2014 Mills ..... A63B 23/1236 482/140
2014/0302973 A1 * 10/2014 Fitterer ..... A63B 26/003 482/142
2015/0196799 A1 * 7/2015 Chua ..... A63B 23/1236 482/141
2015/0258363 A1 * 9/2015 Kampinski ..... A63B 21/4035 482/139
2016/0199690 A1 * 7/2016 Islas ..... A63B 23/10 482/79
2016/0296794 A1 * 10/2016 Land ..... A63B 23/03508
2017/0291063 A1 * 10/2017 Polenz ..... A63B 21/028
2018/0028853 A1 * 2/2018 Cargill ..... A63B 21/00047

* cited by examiner

COLLAPSIBLE EXERCISE BOARD AND EQUIPMENT

BACKGROUND

This application claims the provisional patent application 62,279,988 filed on Mar. 31, 2017.

The present invention relates generally to the field of exercise equipment. More particularly, the invention relates to a collapsible and adjustable exercise board with additional attachments that folds into a compact and easily transportable design.

At home exercise equipment, has been an increasing in the United States. As health conscience consumers are looking to ways to get a full exercise regime at home, a large number of exercise equipment has been created to provide these consumers with the necessary equipment to fulfill their requirements.

Many of these pieces of equipment allow the user to exercise several muscle groups in one to allow the consumer with the greatest use out of the equipment. However, many of these pieces of equipment are large and bulky and require a large amount of space to store the equipment. Several pieces of equipment have been designed to be easily stored, but do not have the versatility to allow the consumer to work out many muscle groups with one piece of equipment and therefore require the consumer to buy a larger number of pieces. This results in more cost, and without much space saving.

Some of these pieces of equipment that are designed to be space saving, are very complicated to setup and take down or are difficult to transport because of the awkward shape they fold down into or have various parts that are not connected therefore the consumer must move multiple pieces.

Therefore, it is necessary for a product to be invented that provides a versatile piece of exercise equipment that is easy to setup and take down, that is easy to store, and that is easy to transport. The present invention seeks to solve these problems.

SUMMARY

The present invention encompasses, in a first embodiment, an exercise board comprising: a first top and second top rotatably engaged side by side from a folded position into a coplanar operating position, wherein the first top has a first cavity and the second top has a second cavity, a first board and a second board rotatably engaged side by side from a folded position into a coplanar operating position, wherein along a first edge of the first board is rotatably engaged with a first edge of the first cavity; and a folding step foldable from an inoperable position to an operating position and comprised of a upper step and a lower step; a upper front panel extending between the upper step and the lower step and rotatably engaged to the upper step and the lower step; a lower front panel extend from the lower step and rotatably engaged with the lower step; a front and a rear side panels on each side of the steps being rotatable relative to one another; and a rear panel rotatably engaged with the upper step and both of the rear side panels rear panel, wherein the rear panel has a plurality of openings in a predetermined set of columns and rows.

In another embodiment, the present invention is an exercise board comprising; a first top and second top rotatably engaged side by side from a folded position into a coplanar operating position, wherein the first top has a first cavity and the second top has a second cavity, a first board and a second board engaged side by side from a folded position into a coplanar operating position, wherein along a first edge of the first board is rotatably engaged with a first edge of the first cavity, and a folding step foldable from an inoperable position to an operating position comprising, an upper step having a first edge and a second edge, an upper front panel having a first edge and a second edge, wherein the first edge is rotatably engaged with the first edge of the upper step, a lower step having a first edge and a second edge, wherein the first edge of lower step is rotatably engaged with the second edge of the upper front panel, a lower front panel having a first edge, a second edge, a third edge, and a fourth edge, wherein the first edge of the lower panel is rotatably engaged with the second edge of the lower step, a rear panel having a having a first edge, a second edge, a third edge, and a fourth edge, wherein the first edge is rotatably engaged with the second edge of the upper step and the second edge of the rear panel is rotatably engaged with a first edge of the second top, a first and second rear side panels having a first edge and a second edge, wherein the first edge of the rear side panels are rotatably engaged with the third and fourth sides of the rear panel respectively, and a first and second front side panels having a first edge and a second edge, wherein the first edge of the rear side panels are rotatably engaged with the third and fourth sides of the lower front panel and the second edge of the first and second side panels are rotatably engaged with the second edge of the first and second rear side panels.

DETAILED DESCRIPTION

Figure 1:
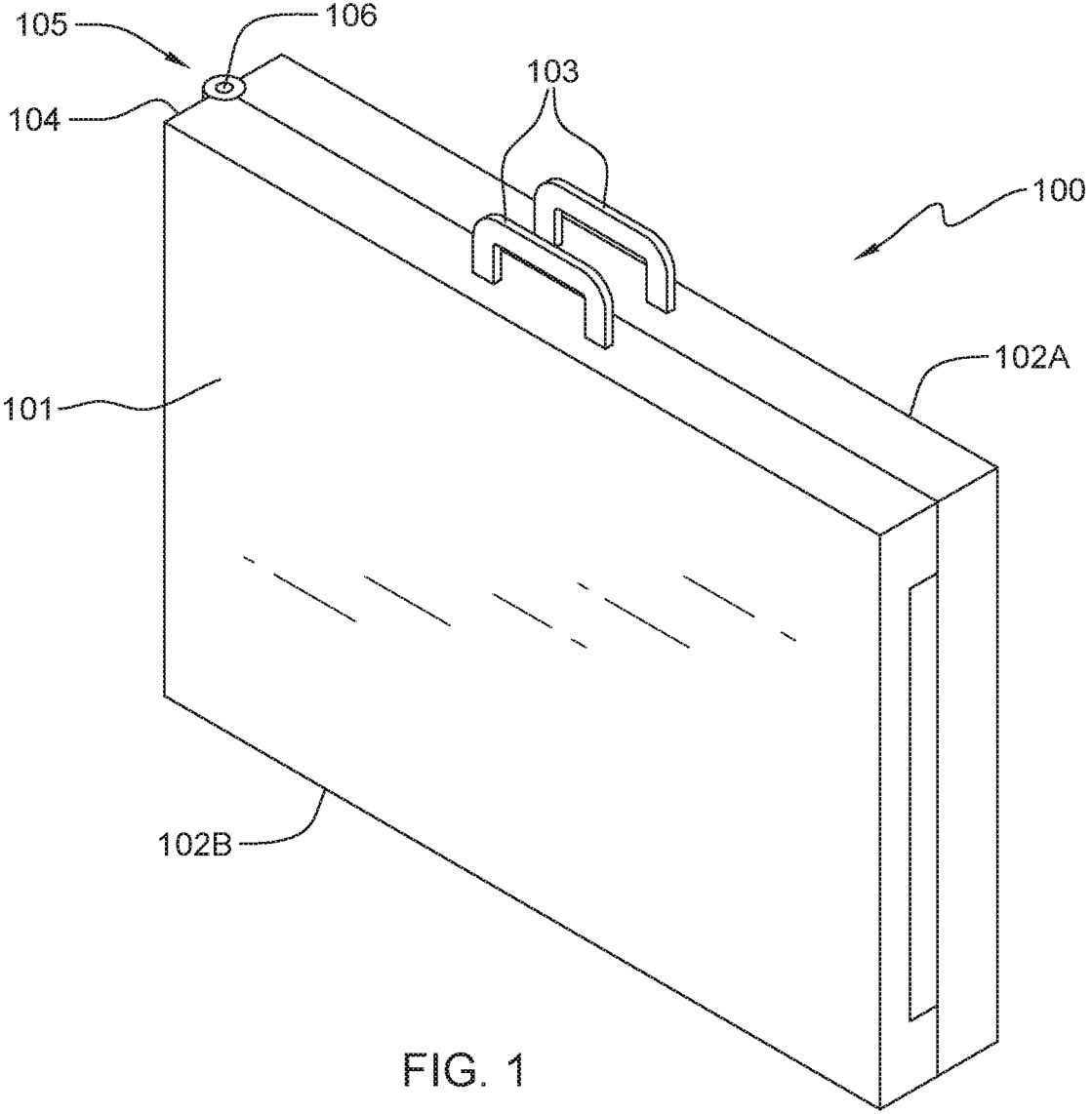
FIG. 1 depicts a perspective view of an exercise board in a closed position, in accordance with one embodiment of the present invention.

As will be appreciated by one skilled in the art, aspects of the present invention may be embodied as an exercise board. Accordingly, aspects of the present invention are designed to create a single piece of exercise equipment that is easy to assemble and disassemble, can easily be transported due to the compact design, and provide a magnitude of setups to allow for various exercises to be performed. The exercise board may be used as a step stool or an inversion board.

The present invention provides the advantages of a device which allows a user to perform multiple different exercises with a single piece of equipment. This is advantageous because it reduces the amount of equipment that a user needs to do a complete workout while also allowing the user a collapsible device that is easy to store as well. In the closed position the device is relatively thin and can be slide under a bed or easily placed within a closet or can easily be transported as well if going to or coming from a gym or workout facility. The device also has multiple different pieces of equipment to provide a more complete workout, allowing the user the opportunity to perform multiple different exercises with the device. Thereby further reducing the amount of equipment the user will need, and also having all of the equipment contained in the device.

As will be apparent to those of skill in the art upon reading this disclosure, each of the individual embodiments described and illustrated herein has discrete components and features which may be readily separated from or combined with the features of any of the other several embodiments without departing from the scope or spirit of the present invention. It is to be understood that this invention is not limited to particular embodiments described, as such may, of course, vary. It is also to be understood that the terminology used herein is for the purpose of describing particular embodiments only, and is not intended to be limiting, since the scope of the present invention will be limited only by the appended claims.

Unless defined otherwise, all technical and scientific terms used herein have the same meaning as commonly understood by one of ordinary skill in the art to which this invention belongs. Although any methods and materials similar or equivalent to those described herein can also be used in the practice or testing of the present invention, the preferred methods and materials are now described.

All publications and patents cited in this specification are herein incorporated by reference as if each individual publication or patent were specifically and individually indicated to be incorporated by reference and are incorporated herein by reference to disclose and describe the methods and/or materials in connection with which the publications are cited. The citation of any publication is for its disclosure prior to the filing date and should not be construed as an admission that the present invention is not entitled to antedate such publication by virtue of prior invention. Further, the dates of publication provided may be different from the actual publication dates which may need to be independently confirmed.

It must be noted that as used herein and in the appended claims, the singular forms "a", "an", and "the" include plural referents unless the context clearly dictates otherwise. It is further noted that the claims may be drafted to exclude any optional element. As such, this statement is intended to serve as antecedent basis for use of such exclusive terminology as "solely," "only" and the like in connection with the recitation of claim elements or use of a "negative" limitation.

The present invention will now be described in detail with reference to the Figures.

Figure 2:
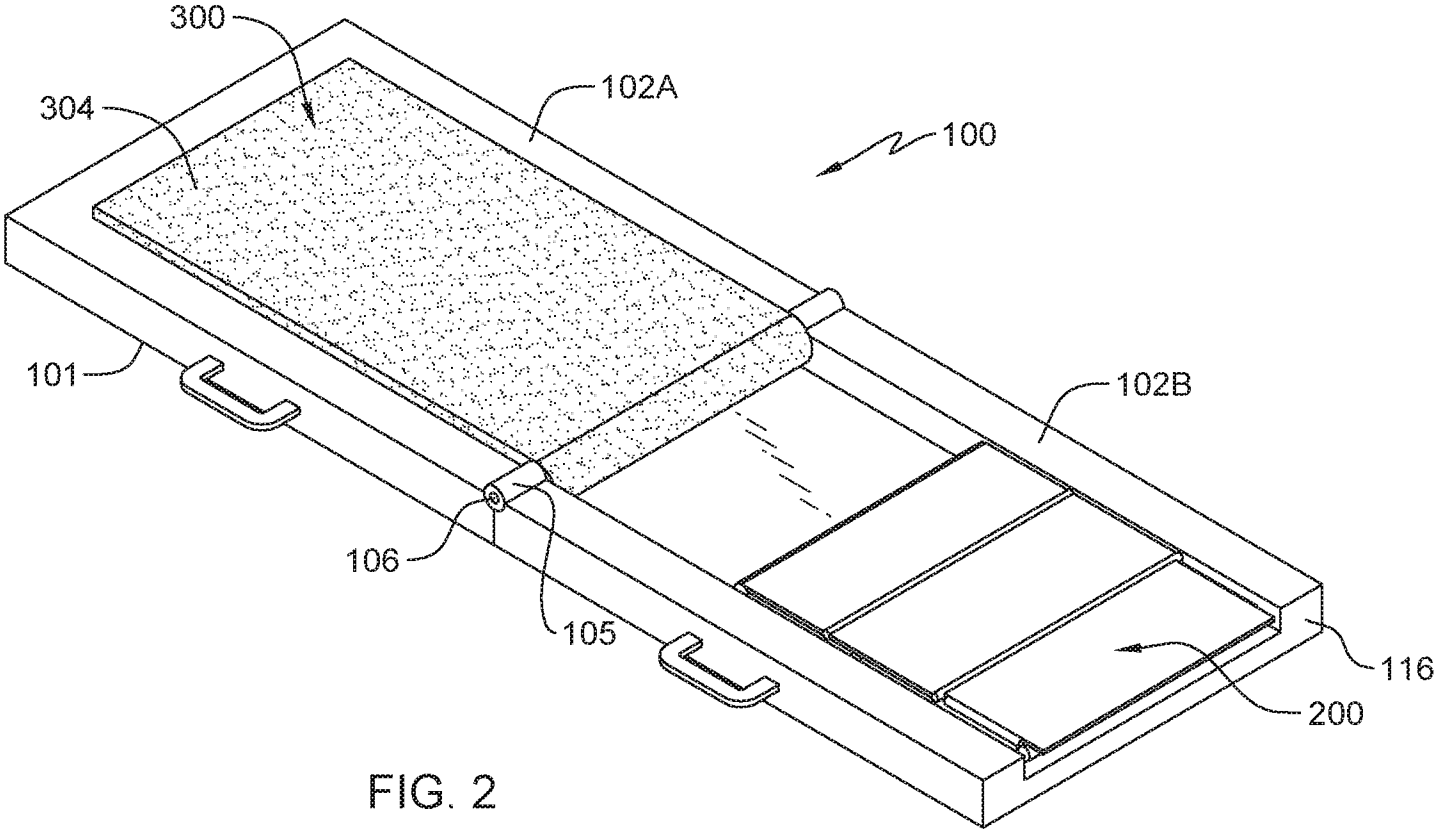
FIG. 2 depicts a perspective view of the exercise board in a first stage of assembly, in accordance with one embodiment of the present invention.

FIG. 1 depicts a perspective view of an exercise board 100 in a closed position, in accordance with one embodiment of the present invention. The exercise board 100 is comprised of two sides (also referred to as tops) 102A and 102B and are provided with a bottom surface 101. In the depicted embodiment, the exercise board 100 is further provided with a pair of hand grips 103 fastened therewith to the sides. The hand grips 103 are used for transporting the exercise board 100. When the exercise board 100 is closed, as depicted, the hand grips 103 are aligned. At a first end 104 a hinge 105 connects the two sides 102A and 102B. In some embodiments, the two sides have the mating ends of the hinge 105 integrated through the manufacturing process, such as injection molding and a shaft 106 is inserted through the sides to secure them together and allow for rotation about the shaft 106. In additional embodiments, the hinge 105 may be a separate assembly, which is affixed to the sides to join the sides together. The hinge assembly is secured using a shaft 106 to enable the two parts of the hinge assembly to turn on the shaft 106. In some embodiments, a locking mechanism is disposed on a side of sides 102A and 102B to secure the two sides together for easier transportation. The locking mechanism may be a latch. In various embodiments, different types of locking or latching mechanisms maybe used. FIG. 2 depicts a perspective view of the exercise board 100 in a first stage of assembly, in accordance with one embodiment of the present invention. When the exercise board 100 is unfolded, the bottom surface 101 lays against a surface (typically the ground) and the two sides 102A and 102B lay substantially flat against this surface. In the unfolded position, a stool 200 is shown in the closed position within the cavity of the side 102B and a body board 300 is shown folded and within the cavity of side 102A. In the depicted embodiment, each side 102A and 102B, has a pre-shaped cavity to fit the stool 200 in the closed position and the body board 300 in the closed and open position. These cavities allow for the body board 300 and the stool 200 to be contained within the exercise board 100, when the exercise board 100 is folded as shown in FIG. 1.

The stool 200 is rotatably attached along an edge 116 of the side 102B. This allows the stool 200 to rotate about the attachment point from a "closed" position to an "open" position (shown in FIGS. 4 & 5). In the depicted embodiment, the edge of the stool 200 and the edge of the side 102B have an interlocking hinge design. In some embodiments, a shaft is inserted through the stool 200 and the side 102B securing the two parts together, but also allowing rotation along the shaft. In additional embodiments, the hinge maybe an assembly secured to both the stool 200 and the side 102A.

The body board 300 is designed to allow a user to lay on the board to perform certain exercises that require either a flat, including, or inverted board. The body board 300 is made of a stiff material that is able to support the weight of the user. In the depicted embodiment, the body board 300 is shown folded in half and made from a single layer of material. In additional embodiments, the body board 300 may have multiple layers, such as a padding layering to improve the comfort for the user. The body board 300 may also have a hinge connected two separate members similar to the other hinges used in the exercise board 100. The body board 300 is rotatably secured to the side 102A along edge 108 within the cavity. The body board 300 is secured through a hinge or other rotatable attachment means to allow the body board 300 to be rotated to various angles and positions which coincide with openings disposed on the stool 200 (shown in FIGS. 4 and 5). In one embodiment, a hinge and shaft is used to secure the body board 300 along edge 108. In some embodiments, the body board 300 and the side 102A may have mating hinged members which are secured together with a shaft. In additional embodiments, a hinge assembly may be secured to the body board 300 and the side 102A In the depicted embodiment, the body board 300, is hinged and folded.

In some embodiments, the body board 300 is designed to unfold along a hinge which connected a portion (also referred to as panel or board) 302 and a portion (also referred to as panel or board) 304. The hinge design is similar in nature to the previously described hinges. In one embodiment, the two portions 302 and 304 have the interlocking hinge elements, with a shaft securing the two portions 302 and 304 together but permitting rotation until the two portions are substantially parallel. This assists in keeping the body board 300 flat when in use.

Figure 3:
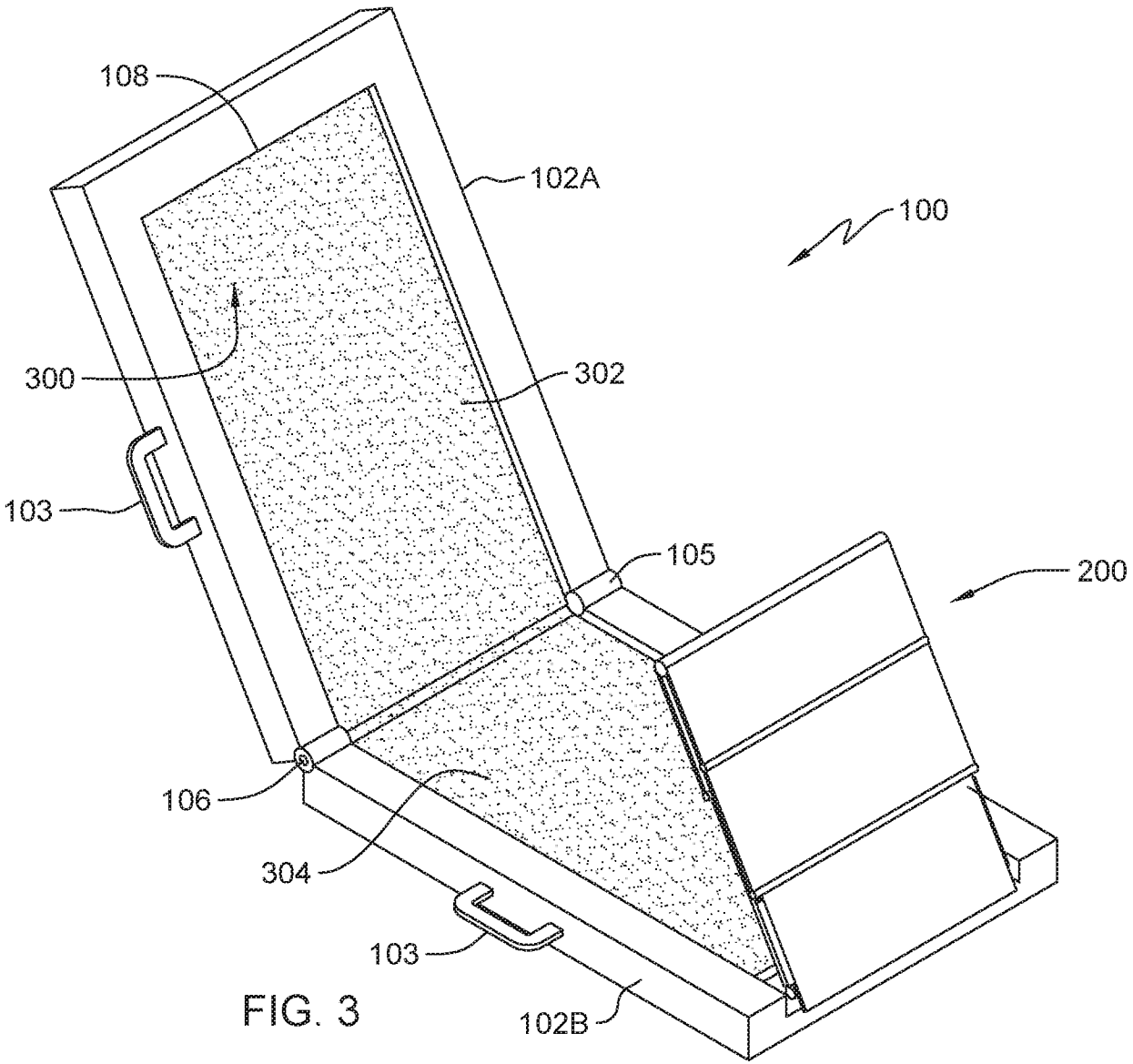
FIG. 3 depicts a perspective view of the exercise board in a second stage of assembly, in accordance with one embodiment of the present invention.

FIG. 3 depicts a perspective view of the exercise board 100 in a second stage of assembly, in accordance with one embodiment of the present invention. In the depicted embodiment, the stool 200 is in an intermediate position of the assembly process. The stool 200 remains in the compacted or "closed position" until an angle greater than ninety (90) degrees is reached when rotating, and the panels begin to expand and form the stool 200 In the depicted embodiment, the body board 300 is shown unfolded. Side 102A is shown rotated about the hinge 105. In some embodiments, the body board 300 may be unfolded, as shown, and the stool 200 is able to be sandwiched between the two halves of the body board 300, and the exercise board 100 is still able to be closed and locked in the position depicted in FIG. 1. The process by which the stool 200 is unfolded is explained in detail in FIG. 6.

Figure 4:
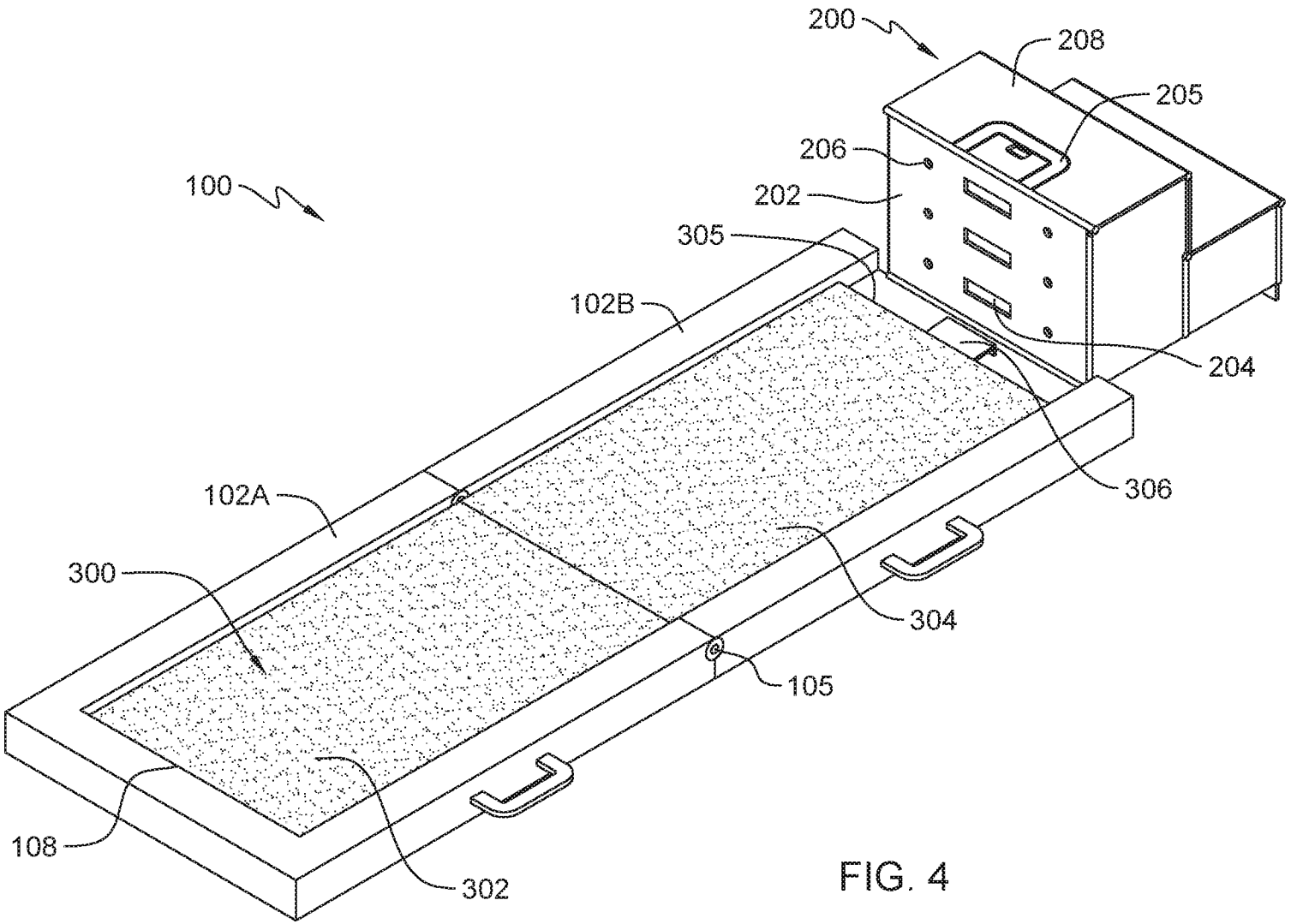
FIG. 4 depicts a perspective view of the exercise board in a third stage of assembly, in accordance with one embodiment of the present invention.

FIG. 4 depicts a perspective view of the exercise board 100 in a third stage of assembly, in accordance with one embodiment of the present invention. In the depicted embodiment, the stool 200 is shown in the "open" position and the body board 300 is shown unfolded. A rear panel 202 of the stool 200 is shown having a plurality of slots 204, and openings 206. The slots 204 are designed to receive a hook 306, which is attached to the body board 300 and secure the body board 300 at an angle. The slots 204 are sized to receive the hook 306. The openings 206 are designed to allow the passage of workout bands or rope to assist in various exercises. In the depicted embodiment, the slots 204 and openings 206 are shown in three rows. In additional embodiments, various patterns of the slots 204 and the openings 206 may be present on the rear panel 202. In the depicted embodiment, an upper step 208 has a handle 205 integrated into the surface. So that when opening or closing the stool 200, a user is able to use the handle 205. The handle is integrated into the upper step 208, so that when the handle 205 is in the closed position, the surface of the upper step 208 is substantially flat. In some embodiments, the handle 25 may have a cavity which the handle 205 fits within when not being used.

In the depicted embodiment, the body board 300, is shown in an unfolded position and is able to lay substantially flat within the cavity of sides 102A and 102B, with the sides obstructing the body board 300. Along edge 305 of panel 304, a hook 306 is shown extending outwards from the edge towards the stool 200. The hook 306 is designed and sized to fit within the slots 204.

Figure 7:
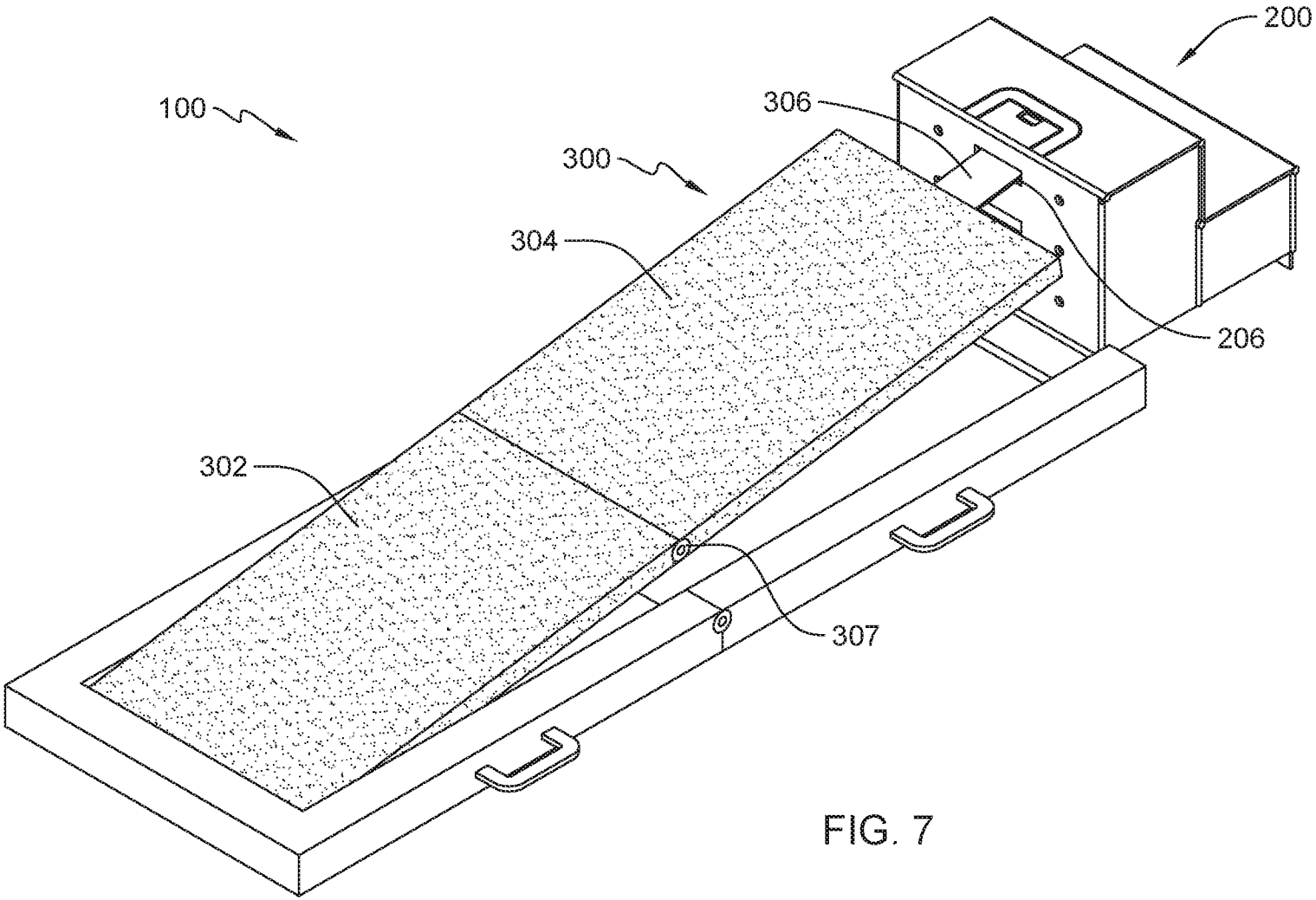
FIG. 7 depicts the exercise board in a fourth stage of assembly, in accordance with one embodiment of the present invention.

FIG. 7 depicts a perspective view of the exercise board 100 in a fourth stage of assembly, in accordance with one embodiment of the present invention. In the depicted embodiment, the body board 300 is shown in an inverted position, wherein a set of hooks 310 are secured at an edge of the portion 306 and extend into the openings 215 on the rear panel 210 of the stool 200. The hooks 310 are able to be removed and inserted depending on the preferred angle. In some embodiments, the hooks 310 are telescopic and are able to retract into the end of the portion 306. In the depicted embodiment, the body board 300 is shown in an inverted position, wherein the hook 306 is secured within slot 204. The hook 306 is able to extend from edge 305 of the panel 304. In some embodiments, the hook 306 is integrated into the panel 304 and is telescopic or the like to be able to extend the distance from the edge 305 to the slot 204. The hook 306 is made of a material that is able to hold the weight of the user and secure the body board 300 in place. In some embodiments, the hook 306 is removable from the body board 300. In some embodiments, the panel 304 has a cavity on the end 305 wherein the hook 306 is inserted into and is extendable.

Figure 5:
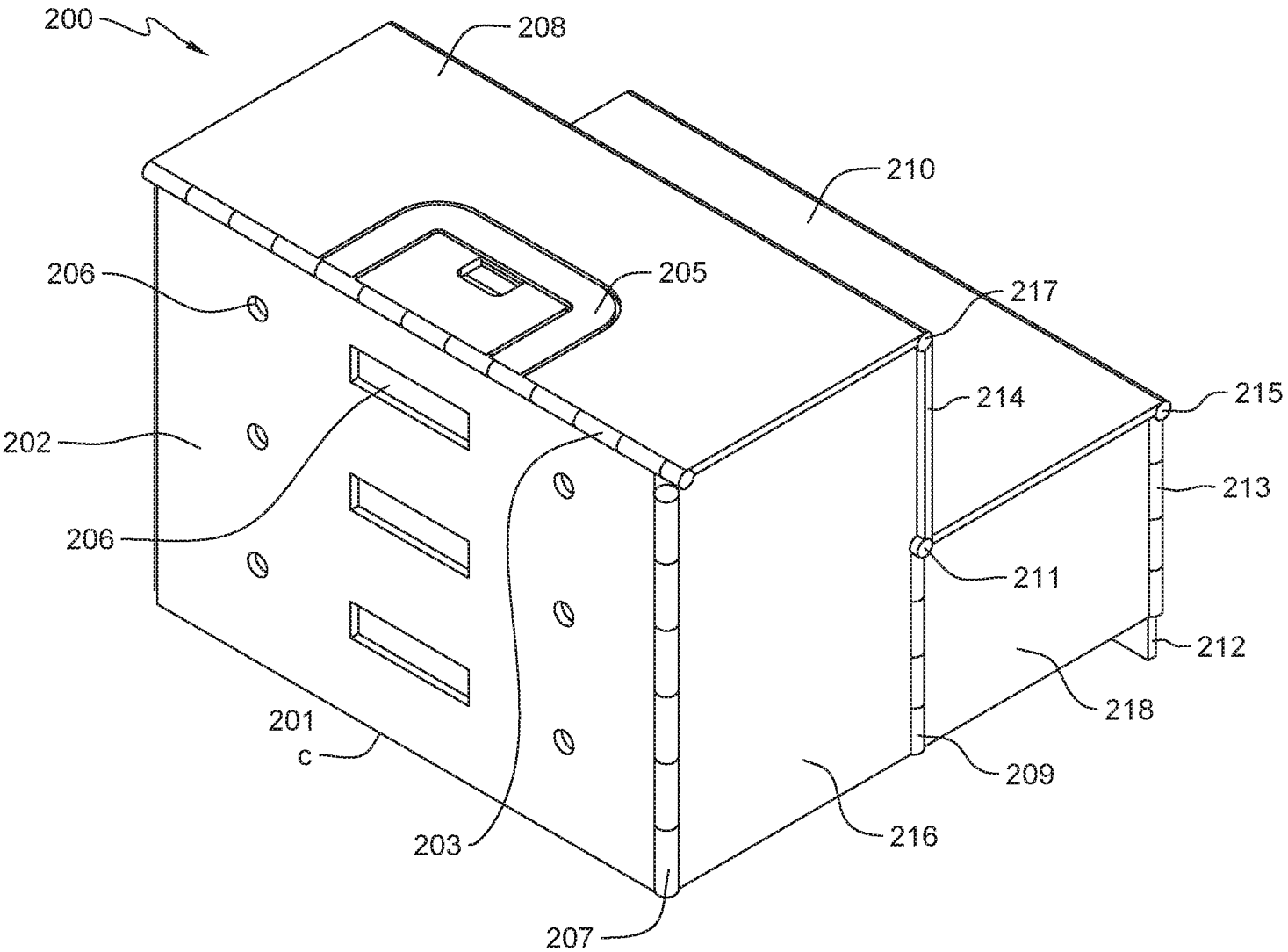
FIG. 5 depicts a perspective view of a stool, in accordance with one embodiment of the present invention.
Figure 6:
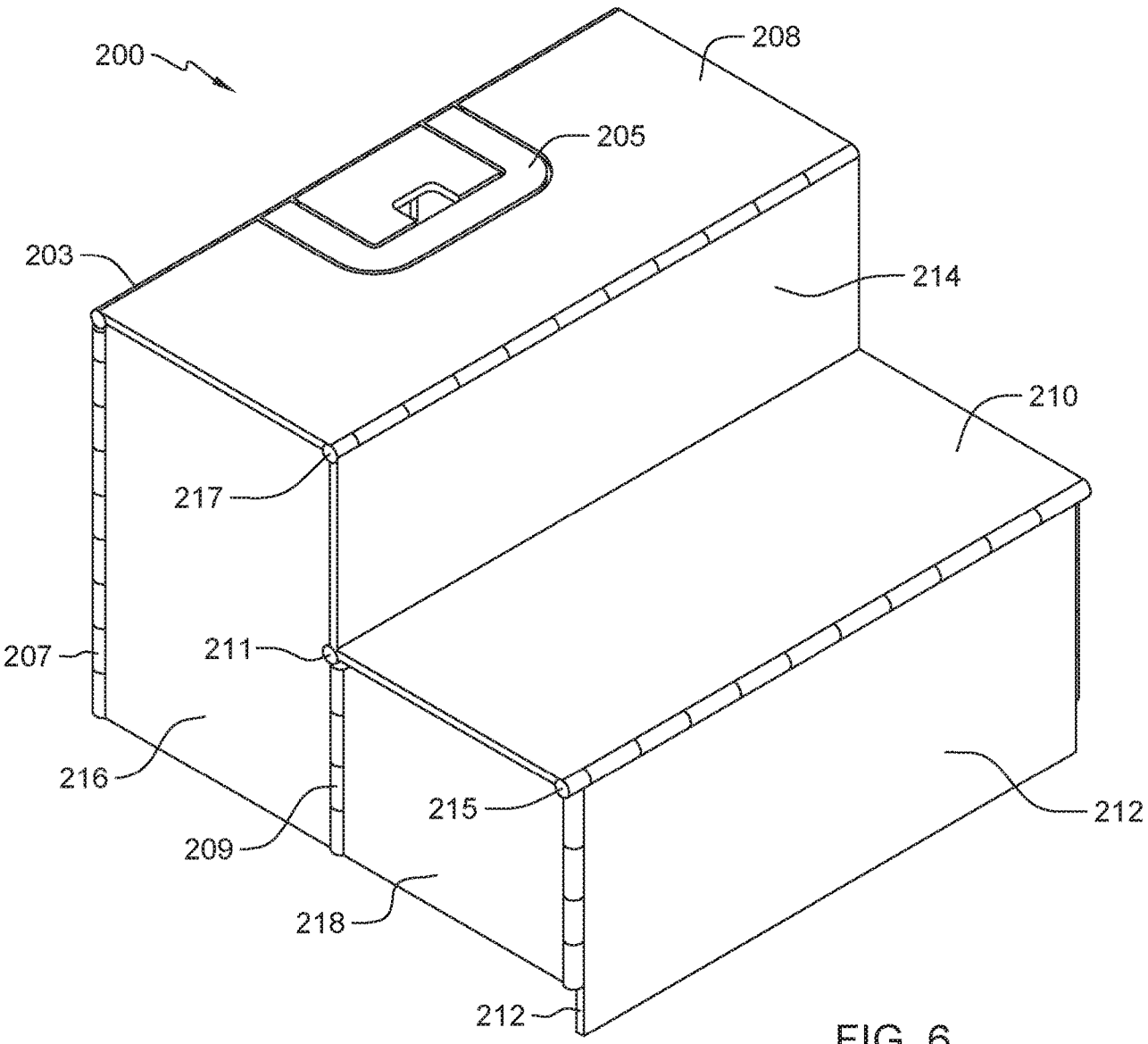
FIG. 6 depicts another perspective view of the stool, in accordance with one embodiment of the present invention.

FIGS. 5 & 6 depicts perspective views of the stool 200 in an assembled position, in accordance with one embodiment of the present invention. In the depicted embodiment, the stool 200 consists of an upper step 208 and a lower step 210, a lower front panel 212 and an upper front panel 214, a side rear panel 216, and a side front panel 218. The side panels 216 and 218 are on each side of the stool 200 and interact with the rest of the panels and steps the same on both sides of the stool 200. The upper step 208 is connected to the upper front panel 214 and the rear panel 202. The upper front panel 214 is connected to the lower step 210. The lower step 210 connected to the lower front panel 212. The lower front panel 212 is connected to the front side panels 218. The rear panel 202 is connected to the rear side panels 216. The side panels 218 and 216 are connected to one another. Edge 201 of the rear panel 202 is attached to the side 102B through the hinged means explained above. In the depicted embodiment, along the connections between the panels and steps, the connection means are hinges to allow the panels and steps to rotate. Hinges 203, 207, 209, 211, 213, 215, and 217 are similar to the hinges described above. In some embodiments, the hinges have an elongated rod inserted through the mating portion of the steps and panels. This hinged assembly allow for the stool 200 to be in a substantially flat position when in a "closed" position to expand outwards when put into the "open" position. This is accomplished by the side panels 216 and 218 folding in, and the steps and front panels folding inwards towards the rear panel 202.

In the depicted embodiment, the front panel 212 is hinged to the front side panels 218 and the lower step 210. The lower step 210 is hinged to the upper front panel 214. The front panel 212 is hinged to the upper step 208. The upper step 208 is hinged to the rear panel 202. The rear panel is hinged to the rear side panels 216. The side panels 216 are hinged to the side front panels 218.

In the depicted embodiment, the front side panel 212 extends beyond the lower edge of the side panels 218, 216, and the rear panel 202 to compensate for the height difference from the attachment point along edge 201 of the rear panel 202 and the height of side 102B. This allows the upper step 208 and the lower step 210 of the stool 200 to side substantially parallel to the surface which the exercise board 100 is placed on.

In additional embodiment, legs are designed to extend from the panel 304 when the body board 300 is unfolded, and at an angle greater than ten (10) degrees, to provide additional support for the body board 300 and keep the body board 300 from bending. The legs provide additional structural support for the body board 300. The legs may be rotatably secured to the body board 300 for easy release when the body board 300 is inclined. In some embodiments, there may be more than two legs or there may only be one leg. In additional embodiments, the legs have footer to decrease sliding of the legs, when extended.

The exercise board 100 and the components which comprise the exercise board 100 may be made from, but not limited to polyethylene, polyethylene terephthalate, high-density polyethylene, polypropylene, polystyrene, polyvinyl chloride, polyurethane, poly carbonate, polybutylene terephthalate, acrylonitrile styrene acrylate, acrylics, aluminum, steel, cooper, various other metals, a combination of plastics and metals, or the like.

A number of embodiments of the invention have been described. Nevertheless, it will be understood that various modifications may be made without departing from the spirit and scope of the invention. For example, in some embodiments. Accordingly, other embodiments are within the scope of the following claims.

What is claimed is:

1. An exercise board comprising:

a first top and second top rotatably engaged side by side from a folded position into a coplanar operating position, wherein the first top has a first cavity and the second top has a second cavity;

a first board and a second board rotatably engaged side by side from a folded position into a coplanar operating position, wherein along a first edge of the first board is rotatably engaged with a first edge of the first cavity; and a folding step foldable from an inoperable position to an operating position and comprised of a upper step and a lower step; a upper front panel extending between the upper step and the lower step and rotatably engaged to the upper step and the lower step; a lower front panel extend from the lower step and rotatably engaged with the lower step; a front side panel and a rear side panel on each side of the steps being rotatable relative to one another; and a rear panel rotatably engaged with the upper step and both of the rear side panels, wherein the rear panel has a plurality of openings in a predetermined set of columns and rows.

2. The exercise board of claim 1, further comprising at least one cavity on a first edge of the second board.

3. The exercise board of claim 2, further comprising at least hook which is designed to fit within one of the at least one cavity and pass through one of the plurality of openings in the rear panel so that the first board configured to be positioned at an angle greater than zero.

4. The exercise board of claim 3, wherein the at least one hook are telescopic.

5. The exercise board of claim 3, wherein the at least one hook are retactable into the at least one cavity of the second board.

6. The exercise board of claim 1, wherein when the folding step is in the inoperable position, the second cavity substantially fits the folding step.

7. The exercise board of claim 6, wherein the first board when in an inoperable position, the first cavity substantially fits the first board.

8. The exercise board of claim 7, wherein when the first top and the second top are in an inoperable position, the first board and the folding step are substantially contained within the first top and the second top.

9. The exercise board of claim 1, further comprising padding along a top surface of the first board.

10. The exercise board of claim 1, wherein the rear panel of the folding step is at least thirty inches in length.

11. The exercise board of claim 1, wherein the folding step has a retractable handle on the upper step.

12. The exercise board of claim 1, further comprising a set of handles disposed on the first top and the second top, so when the first top and the second top are in the folded position, the handles substantially align.

13. An exercise board comprising:

a first top and second top rotatably engaged side by side from a folded position into a coplanar operating position, wherein the first top has a first cavity and the second top has a second cavity;

a first board and a second board engaged side by side from a folded position into a coplanar operating position, wherein along a first edge of the first board is rotatably engaged with a first edge of the first cavity; and a folding step foldable from an inoperable position to an operating position comprising, an upper step having a first edge and a second edge, an upper front panel having a first edge and a second edge, wherein the first edge is rotatably engaged with the first edge of the upper step, a lower step having a first edge and a second edge, wherein the first edge of lower step is rotatably engaged with the second edge of the upper front panel, a lower front panel having a first edge, a second edge, a third edge, and a fourth edge, wherein the first edge of the lower panel is rotatably engaged with the second edge of the lower step, a rear panel having a having a first edge, a second edge, a third edge, and a fourth edge, wherein the first edge is rotatably engaged with the second edge of the upper step and the second edge of the rear panel is rotatably engaged with a first edge of the second top, a first and second rear side panels having a first edge and a second edge, wherein the first edge of the rear side panels are rotatably engaged with the third and fourth sides of the rear panel respectively, and a first and second front side panels having a first edge and a second edge, wherein the first edge of the rear side panels are rotatably engaged with the third and fourth sides of the lower front panel and the second edge of the first and second side panels are rotatably engaged with the second edge of the first and second rear side panels.

14. The exercise board of claim 13, further comprising at least one cavity on a first edge of the second board.

15. The exercise board of claim 14, wherein the rear panel has a plurality of rectangular openings and a plurality of circular openings.

16. The exercise board of claim 15, further comprising a hook designed to fit within the at least one cavity and pass through one of the plurality of rectangular openings in the rear panel.

17. The exercise board of claim 16, wherein the hook is telescopic.

18. The exercise board of claim 13, wherein the upper step further comprising a cavity, in which a handle is able to fit and is rotatably engaged with the upper step, and when the handle is within the cavity, a first surface of the upper step is substantially flat.

* * * * *